United States Patent [19]

McGill

[11] Patent Number: 4,658,446

[45] Date of Patent: Apr. 21, 1987

[54] HEAD COVERING WITH MOVABLE ANIMATIONS

[76] Inventor: Philip J. McGill, 637 Tully Rd., Modesto, Calif. 95350

[21] Appl. No.: 817,958

[22] Filed: Jan. 13, 1986

[51] Int. Cl.[4] ..... A42B 1/06

[52] U.S. Cl. ..... 2/209.1; 446/26

[58] Field of Search ..... 2/209.1, 199; 46/123; 446/27, 26

[56] References Cited

U.S. PATENT DOCUMENTS 1,618,517 2/1927 Cureton ..... 446/27

4,268,918 5/1981 Lee ..... 2/199

*Primary Examiner*—Doris L. Troutman

*Attorney, Agent, or Firm*—Townsend and Townsend

[57] ABSTRACT

A hat or cap defining a head covering provided with a front portion having a pair of relatively shiftable members which can simulate on a small scale apparently spontaneous lifelike movement, such as the clapping of hands. The members are pivotally coupled by pins to respective ends of a rigid crossbar. The front portion of the head covering has spaced slits through which the end portions of the cross bar extend so that the major portion of the crossbar is inside the head covering and concealed from view. A string coupled to the member passes through the head covering and out of the rear end thereof so that the wearer can pull the string and move the members toward each other. A spring is provided for biasing each member, respectively, away from the other member so that the springs and string work together to provide reciprocal movement of the members as the string is pulled and released. Fabric sleeves or tubes are used to cover the members, and the outer ends of the sleeves can be shaped to provide a special effect, such as hands if clapping of the hands is to be simulated by movements of the members.

10 Claims, 4 Drawing Figures

HEAD COVERING WITH MOVABLE ANIMATIONS

This invention relates to a new type of novelty item worn on the body and, more particularly, to a head covering having actuatable, movable members which provide simulated lifelike movements when the members are actuated.

BACKGROUND OF THE INVENTION

Caps or hats having simulated animal features movably mounted on the sides thereof have been known and used in the past. Examples of such caps or hats are those disclosed in U.S. Pat. Nos. 1,618,517 and 4,268,918. However, none of the structural features of caps or hats of this type suggests at least a pair of animated members at the front portion of a cap or hat, which members are mounted in such a way as to provide apparently spontaneous, lifelike movements to an observer looking at the hat when it is worn by the wearer. Thus, a need exists for a hat or head covering which has the frontal area of the cap provided with at least a pair of actuatable, movable animated members forming parts of an operable mechanism to provide an entertaining spectacle each time the mechanism is actuated and as the hat or head covering is worn on the head of a wearer. The present invention satisfies this need.

SUMMARY OF THE INVENTION

The present invention is directed to a head covering having a front portion on which is mounted a pair of elongated, relatively shiftable members which are designed to simulate spontaneous, lifelike movements when the members are shifted relative to the hat. The shifting action is caused by a moving means coupled to the members and actuated by the wearer from a location spaced from the hat. The simulated movements can be of any desired type, such as the clapping of hands, in which the members are moved toward each other by the actuation of the moving means, the return movements of the members being caused by bias means coupled with the members in such a way that the members are biased away from each other. In this way, the members are caused to move toward and away from each other a number of times to thereby simulate the lifelike movements, all of which can occur as the hat is worn on the head in a normal fashion.

The primary object of the present invention is to provide a head covering of improved design wherein the front portion of the head covering has an assembly including a pair of members which are movable relative to the hat toward and away from each other to simulate spontaneous lifelike movements while the head covering is worn on the head.

Another object of the present invention is to provide a head covering of the type described wherein the head covering can be a conventional cap or hat and the movable members can be easily mounted on the head covering to minimize its production cost.

Other objects of this invention will become apparent as the following specification progresses, reference being had to the accompanying drawing for an illustration of the invention.

IN THE DRAWING

Figure 1:
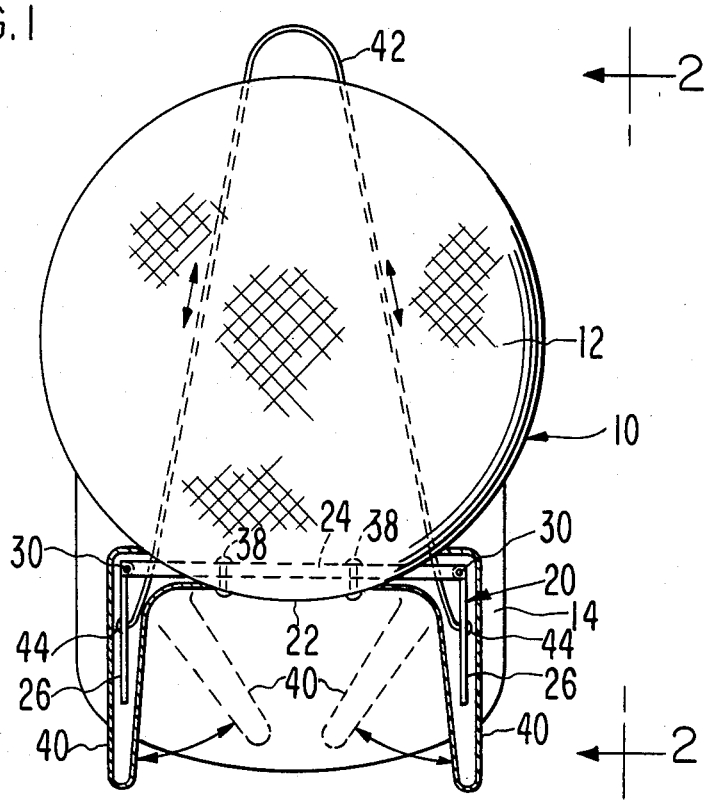
FIG. 1 is a top plan view of the improved head covering of this invention showing the pair of shiftable members at the front end of the head covering and the string actuator for causing movement of the members relative to each other.

The head covering of the present invention will hereinafter be described as a cap 10 having a dome-shaped main body 12 adapted to fit over the head of the wearer. The head covering could also be of any other construction so long as the head covering has a front portion.

Cap 10 is conventional in construction and includes a forwardly extending brim 14 and a flexible headband 16 which can be adjustable as is well-known to allow it to fit on heads of different sizes. The cap typically has a rear opening 18 above the rear part of headband 16 to facilitate the adjustment of the band for proper fit on the head of the wearer.

Figure 2:
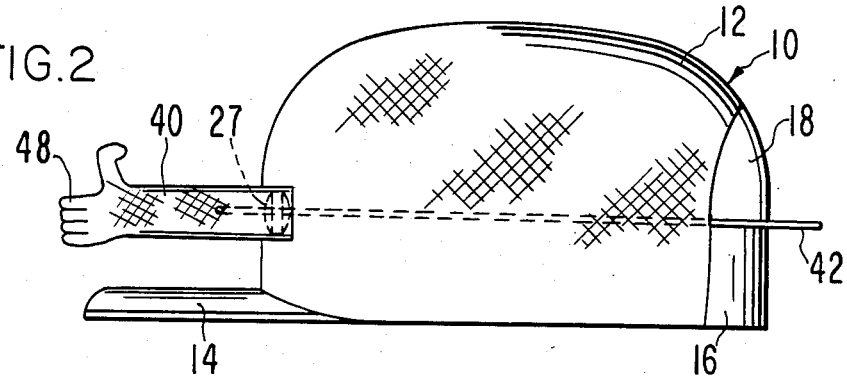
FIG. 2 is a side elevational view taken along line 2—2 of FIG. 1.
Figure 3:
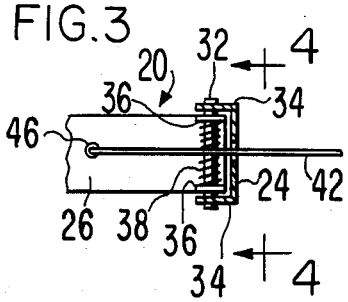
FIG. 3 is a fragmentary, cross-sectional view of the mechanism for mounting and moving one of the members.

A movable animated assembly is mounted on the front portion 22 of cap 10 in the manner shown in FIGS. 1 and 2. Assembly 20 includes a crossbar 24, a pair of arms 26, and hinge means 30 pivotally coupling each arm 26 to a respective end of crossbar 24. The hinge means 30 is shown in more detail in FIGS. 3 and 4 and includes a hinge pin 32 which passes through aligned holes in ears 34 on the upper and lower marginal edges of crossbar 24 and ears 36 on the adjacent end of the corresponding arm 26 as shown in FIG. 3. A torsion spring 38 surrounds each hinge pin 32 between ears 36 and the spring is under tension such that each arm 26 is biased in a direction away from the other arm 26. Thus, the spring associated with the lefthand arm 26 shown in FIG. 1 biases the arm in a clockwise sense when viewing FIG. 1; whereas, the spring associated with the righthand arm 26 biases the arm in a counterclockwise sense.

Crossbar 24 and arms 26 may be of any suitable, relatively rigid material. Typically, the material can be metal or plastic. For purposes of illustration, the material is aluminum which is lightweight in construction yet is relatively rigid so that the crossbar and arms remain substantially straight at all times when coupled with cap 10 as hereinafter described.

Crossbar 24 is secured by a pair of rivets 38 or other fasteners to the front portion 22 of cap 10 inside the cap. The rivets or fasteners 38 extend through the cap and also pass through crossbar 24 as shown in FIG. 1. The end portions of the crossbar extend through respective slots 27 (FIG. 2) in the cap. Thus, the crossbar 24 is in the position shown in FIG. 2 relative to the brim 14 of the cap so that the members 26 can be sufficiently spaced above the brim so that the brim does not engage the members 26 or material carried by the members as hereinafter described.

Members 26 are preferably covered with a material which simulates a particular lifelike feature or features. For purposes of illustration, each arm 26 is provided with a tubular element 40 which fits over the member 26 as shown in FIG. 1 and simulates a hand 48 as shown in FIG. 2. The tubular element is of flexible material, such as a cloth or other fabric material, and the outer end of the element 40 is closed as shown in FIG. 1. The inner end of each element 40 is secured in any suitable manner to cover the adjacent end portion of crossbar 24 and to cover the adjacent slot 27 in the cap. For instance, the inner end of each element 40 can pass through the slot in the front portion 22 of cap 10 and be snugly held in place by fasteners 38. In this way, the crossbar 24 and members 26 can be easily concealed yet the members 26 can be moved toward and away from each other.

Figure 4:
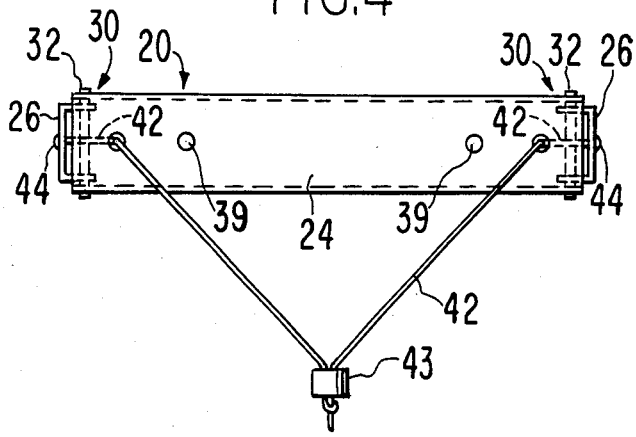
FIG. 4 is a rear elevational view of the mechanism as it is viewed when removed from the head covering.

Means for moving members 26 toward each other and into the dashed line positions of FIG. 1 include an elongated, flexible string 42 which is secured at its ends 44 to respective arms 26 at locations thereon spaced from the axes of pivotal movement thereof as shown in FIGS. 1, 3 and 4. To this end, each string end 44 passes through a hole 46 in the respective arm 26 and a bead is formed on the string to prevent the string from being moved out of the hole when the string is pulled. The string is long enough so that it can extend over the wearer's head when the cap is worn and then out of the rear opening 18 of the cap (FIG. 2) and then downwardly to a certain location where the wearer can pull on the string, causing the arms 26 to move relative to each other and toward the center of the space between the members 26. Thus, when the elements 40 simulate hands 48, the pulling of the string will simulate clapping of the hands as the force due to the pulling of the string is alternately exerted and released a number of times. Upon release of the force, springs 38 return the members to their full line positions of FIG. 1.

String 42 can pass through a grasp member 43 and then be knotted as shown in FIG. 4 so that, by pulling on grasp member 43, the hands 48 can be readily moved toward each other. The length of string 42 can be great enough to extend to the waist of the wearer. In the alternative, the string ends could be knotted together and to a single string attached at the string ends near grasp member 43. This single string would extend downwardly, such as to the waist of the wearer. Another alternative is to use the string without the use of grasp member 43 as shown in FIG. 1.

In use, cap 10 is worn on the head of the wearer when assembly 20 is mounted on the cap in the manner shown in FIGS. 1 and 2. The string 42 is caused to extend downwardly from the rear of the hat and the wearer, upon pulling the string and releasing it a number of times, will cause the elements 40 to move toward and away from each other so that the simulated hands 48 on the outer ends of elements 40 will tend to clap, thereby creating a pleasing, cheering effect.

In FIG. 1, front portion 22 of cap 10 can be provided with an emblem, such as a sports team emblem, an automobile brand emblem, a company logo, a design, a child's or adult's face, a graphic symbol of a smiling face or some other feature, or portion 22 will be left blank. The combination of an emblem or logo on portion 22 with the movements of members 26 upon pulling of string 42 causes the simulated arms 40 and hands 48 to create a hand clapping effect. The end result will be a pleasing, cheering effect for that particular emblem or logo in place on portion 22.

While the present invention has been described as being useful in simulating the clapping of hands mounted in an animated fashion on the front portion of cap 10, there can be a variation. For instance, instead of hands 48 on the outer ends of simulated arms 40, two clapping hands can be mounted by themselves without the use of elements 40 and with the use of pivot pins coupled to the ends of crossbar 24.

While the present invention has been described using two arms 26 mounted by a hinge pin 32 to crossbar 24 with a torsion spring 38, there can be a variation: Instead of using torsion springs 38 and hinge pins 32, they can be replaced by coil springs (extension or compression) located in horizontal positions for attaching arms 26 to crossbar 24. Rubber bands may also be used.

It is possible that other animated devices could be used instead of hands 48. The two hands could be replaced by the following: a baseball bat and a baseball; a baseball glove and a baseball; a hockey stick and a hockey puck; a golf club and a golf ball; a tennis racket and a tennis ball; a basketball and a basketball net; a soccer ball and a soccer ball net; a football and a football goal post; a fishing net and a fish; a fishing pole and a fish; and a fishing pole and fishing hook.

I claim:

1. A head covering comprising:

a body having a front portion;

a pair of elongated members extending forwardly of the front portion each member having a rear end;

means pivotally mounting the rear ends of the members on the front portion of the body for movement toward and away from each other;

means coupled with each member for moving the same in a first direction relative to the front portion of the body; and means coupled with each member for biasing the same in a direction opposite to said first direction.

2. A head covering as set forth in claim 1, wherein said bias means includes a metallic spring for each member, respectively.

3. A head covering as set forth in claim 1, wherein is included means covering the members and movable therewith, said covering means providing an animated feature for simulating a lifelike hand clapping effect observable from a distance.

4. A head covering comprising:

a body having a front portion;

a pair of elongated members;

a crossbar carried by the body and having pivot means at the ends thereof for pivotally mounting respective members thereto with the members extending forwardly from said front portion;

means coupled with each member for moving the same in a first direction relative to the front portion of the body; and means coupled with each member for biasing the same in a direction opposite to said first direction.

5. A head covering comprising:

a body having a front portion;

a pair of elongated members;

a rigid support on the body and having a pair of opposed ends, there being a hinge pin for each member, respectively, each hinge pin pivotally mounting the respective member on a respective end of the support, the members extending forwardly from said front portion;

means coupled with each member for moving the same in a first direction relative to the front portion of the body; and means coupled with each member for biasing the same in a direction opposite to said first direction.

6. A head covering as set forth in claim 5, wherein said bias means includes a torsion spring surrounding each hinge pin, respectively, the torsion spring of each member biasing the member in a direction away from the other member.

7. A head covering as set forth in claim 6, wherein said moving means includes an elongated, flexible device secured at its ends to respective members, said flexible device capable of being pulled to move the members toward each other against the bias force of respective springs.

8. A head covering comprising:

a body having a front portion and a pair of slits through the front portion thereof;

a pair of elongated members;

a rigid crossbar having end portions extending through the slits to expose the ends of the crossbar, there being pivot means pivotally mounting each member on a respective end of the crossbar, the members extending forwardly from said front portion;

means mounting the crossbar on the front portion of the body with the major portion of the crossbar adjacent to the inner surface of the body;

means coupled with each member for moving the same in a first direction relative to the front portion of the body; and means coupled with each member for biasing the same in a direction opposite to said first direction.

9. A head covering as set forth in claim 8, wherein said moving means includes a flexible string having ends secured to respective members, the string passing through the crossbar and extending to a location near the rear of the body.

10. A head covering as set forth in claim 8, wherein the pivot means for each member includes a pivot pin, said crossbar and each member having spaced ears provided with aligned holes therein for receiving the corresponding pivot pin, said bias means including a torsion spring surrounding each pivot pin, respectively.

* * * * *